US009168546B2

(12) United States Patent
Xue et al.

(10) Patent No.: US 9,168,546 B2
(45) Date of Patent: Oct. 27, 2015

(54) COLD GAS DYNAMIC SPRAY APPARATUS, SYSTEM AND METHOD

(75) Inventors: Lijue Xue, London (CA); Shaodong Wang, London (CA); Jiaren Jiang, Vancouver (CA)

(73) Assignee: National Research Council of Canada, Ottawa, ON (CA)

( * ) Notice: Subject to any disclaimer, the term of this patent is extended or adjusted under 35 U.S.C. 154(b) by 931 days.

(21) Appl. No.: 12/654,064

(22) Filed: Dec. 9, 2009

(65) Prior Publication Data

US 2010/0151124 A1 Jun. 17, 2010

Related U.S. Application Data

(60) Provisional application No. 61/193,659, filed on Dec. 12, 2008.

(51) Int. Cl.

| | |
|---|---|
| ***C23C 24/04*** | (2006.01) |
| ***B05D 1/12*** | (2006.01) |
| ***B05C 5/00*** | (2006.01) |
| ***B05B 7/04*** | (2006.01) |
| ***B05B 7/14*** | (2006.01) |

(52) U.S. Cl.

CPC ..... *B05B 7/1486* (2013.01); *C23C 24/04* (2013.01)

(58) Field of Classification Search

CPC ..... B05B 7/1486; B05B 7/04; C23C 24/04; B05D 1/12; B05C 5/00

USPC ..... 239/79, 597, 594, 434.5, 423, 80, 85, 239/422, 112, 116; 451/102; 427/190–192; 118/308; 219/121.47, 121.55; 137/239

See application file for complete search history.

(56) References Cited

U.S. PATENT DOCUMENTS 2,059,983 A * 11/1936 Dent et al. ..... 51/298
4,741,286 A * 5/1988 Itoh et al. ..... 118/620

(Continued)

FOREIGN PATENT DOCUMENTS

EP 1630253 3/2006
JP 2005-095886 4/2005

(Continued)

OTHER PUBLICATIONS

Shkodkin, AV. Mar. 27, 2003. Espacenet abstract of RU 2201472 with drawings from RU 2201472.

(Continued)

*Primary Examiner* — Arthur O Hall
*Assistant Examiner* — Chee-Chong Lee
(74) *Attorney, Agent, or Firm* — Jason E. J. Davis

(57) ABSTRACT

A system for cold gas dynamic spraying of particulate material has a de Laval nozzle and two or more radial particle inlets located between the throat and the outlet of the nozzle, the two or more particle inlets arranged symmetrically around a linear flow path of the nozzle. Blocking of the inlets is reduced by controlling pressure of particle carrier gas to provide a stable particulate material injection pressure before and during introduction of working gas into the nozzle, and/or by clearing the particle inlets of residual particles after a spraying process. Such a system and associated method combines benefits of both downstream and upstream cold gas spray systems. Further, a nozzle for spraying particulate material having a cross-sectional shape that is narrower in a middle section compared to edge sections provides coatings with superior cross-sectional profiles.

25 Claims, 5 Drawing Sheets

(56) References Cited

U.S. PATENT DOCUMENTS

| | | | | |
|---|---|---|---|---|
| 5,233,153 | A * | 8/1993 | Coats | 219/121.47 |
| 5,302,414 | A | 4/1994 | Alkhimov et al. | |
| 5,405,085 | A * | 4/1995 | White | 239/13 |
| 6,139,913 | A | 10/2000 | Van Steenkiste et al. | |
| 6,283,386 | B1 | 9/2001 | Van Steenkiste et al. | |
| 6,402,050 | B1 | 6/2002 | Kashirin et al. | |
| 6,759,085 | B2 | 7/2004 | Muehlberger | |
| 6,811,812 | B2 | 11/2004 | Van Steenkiste | |
| 6,872,427 | B2 | 3/2005 | Van Steenkiste et al. | |
| 6,896,933 | B2 | 5/2005 | Van Steenkiste et al. | |
| 7,108,893 | B2 | 9/2006 | Van Steenkiste et al. | |
| 7,125,586 | B2 | 10/2006 | Van Steenkiste et al. | |
| 7,143,967 | B2 | 12/2006 | Heinrich et al. | |
| 7,557,324 | B2 * | 7/2009 | Nylen et al. | 219/121.47 |
| 2002/0071906 | A1 | 6/2002 | Rusch | |
| 2004/0058064 | A1 | 3/2004 | Fuller et al. | |
| 2004/0166247 | A1 | 8/2004 | Heinrich et al. | |
| 2004/0191449 | A1 | 9/2004 | Haynes et al. | |
| 2005/0040260 | A1 | 2/2005 | Zhao et al. | |
| 2005/0214474 | A1 | 9/2005 | Han et al. | |
| 2005/0229845 | A1 * | 10/2005 | Mather et al. | 118/308 |
| 2006/0201418 | A1 | 9/2006 | Ko et al. | |
| 2007/0138147 | A1 * | 6/2007 | Molz et al. | 219/121.47 |
| 2007/0160769 | A1 | 7/2007 | Maev et al. | |

FOREIGN PATENT DOCUMENTS

| | | | | |
|---|---|---|---|---|
| JP | 2005-95886 | * | 4/2005 | B05B 7/16 |
| RU | 2229944 | | 3/2004 | |
| WO | WO 2006-123965 | | 11/2006 | |

OTHER PUBLICATIONS

Irissou E, et al. "Review on Cold Spray Process and Technology: Part I—Intellectual Property". Journal of Thermal Spray Technology, DOI: 10.1007/s11666-008-9203-3 (2008).

Stoltenhof, T, et al. "An analysis of the cold spray process and its coatings", Journal of Thermal Spray Technology, vol. 11 (2002), No. 4, 542-550.

Villafuerte J. "Cold Spray: A New Technology", Welding J., vol. 84 (2005), No. 5, 24-29.

Schmidt T, et al. "Development of a generalized parameter window for cold spray deposition", Acta Materialia, vol. 54 (2006) 729-742.

Morsi SA, et al. "An investigation of particle trajectories in two-phase flow systems", J. Fluid Mech., vol. 55 (1972), part 2, 193-208.

Marrocco T, et al. Production of titanium deposits by cold-gas dynamic spray: numerical modeling . . . J. Thermal Spray Technology 15(2):263-272 (2006).

Wu T, et al. , Measurement of particle velocity and characterization of deposition in aluminum alloy . . . Applied Surface Science, vol. 252 (2005), 1368-1377.

Hanson TC, et al. "Independent control of HVOF particle velocity and temperature", Journal of Thermal Spray Technology, vol. 11 (2002) 75-85.

Thorpe ML, et al. "A pragmatic analysis and comparison of HVOF processes", Journal of Thermal Spray Technology, vol. 1 (1992) 161-170.

Jiang J, et al. Proc Symp Surf Protection for Enhanced Materials Performances, Materials Science and Technology (MS&T'06), Cincinnati, Ohio, Oct. 15-19, 2006, pp. 571-582.

* cited by examiner

COLD GAS DYNAMIC SPRAY APPARATUS, SYSTEM AND METHOD

CROSS-REFERENCE TO RELATED APPLICATIONS

This application claims the benefit of U.S. Provisional Patent Application Ser. No. 61/193,659 filed Dec. 12, 2008, the entire contents of which is herein incorporated by reference.

FIELD OF THE INVENTION

The present invention relates to cold gas dynamic spray apparatuses, systems and methods, in particular to such apparatuses, systems and methods for coating of particles on a substrate.

BACKGROUND OF THE INVENTION

Cold spray is a relatively new technology that has many advantages over conventional thermal spray processes. It is a solid-state coating and material deposition process in which small solid particles are accelerated to high velocities (e.g. 300 to 1200 m/s) by a supersonic or sub-supersonic jet flow through a de Laval nozzle and are subsequently deposited onto the substrate through an impact process to form a coating or deposition. When the high velocity particles impact on a substrate, severe plastic deformation occurs in the particles as well as in the substrate and a deposit is formed. Helium, argon, air, nitrogen, steam, hydrogen or their mixtures are usually used as the processing gas.

There exists a particle critical impact velocity (a threshold) for successful deposition of a given coating and substrate material combination. Only above this critical velocity, the particles can be successfully deposited to form a coating. This critical velocity depends on the properties of the substrate material and its surface conditions, the properties of the coating material, the powder quality, the particle size and the particle impact temperature. High inlet gas pressure and high inlet gas temperature can increase the gas jet velocity and therefore particle velocity. In addition, helium may be used to increase the gas and particle velocity.

As compared to the conventional thermal spray techniques, one of the most important features of the cold spray process is that the temperature of the sprayed particles is always below their melting points and all of the particles are substantially in the solid-state throughout the spray process. This solid-state processing brings several unique advantages, such as avoiding the undesirable chemical change (such as oxidation) and microstructural change (such as grain growth) during the deposition process and producing minimal or even compressive residual stresses. Therefore, cold spray is ideally suitable for depositing oxygen-sensitive materials (e.g. Al, Mg, Ti, Cu, etc.), temperature-sensitive materials (e.g. nano-structured and amorphous materials) and phase-sensitive material (e.g. carbide composites).

Cold spray has the potential to deposit coatings and/or to build three dimensional structures with high deposition rate, very high purity, high density and many other unique properties. This technology has received more and more interests worldwide from both academia and industry.

Currently, based on how powder is introduced into the jet flow, there are two types of cold spray techniques: upstream powder feeding technique and downstream powder feeding technique. The upstream powder feeding technique uses high pressure gases and has high deposition efficiencies but is very expensive from the point of view of equipment and operational cost. On the other hand, the downstream powder feeding technique uses low pressure gas supplies and is portable and much less expensive. However, due to the low particle velocities that can be reached, the downstream powder feeding technique can only deposit limited number of materials and the deposition efficiencies are much lower.

Upstream Powder Feeding Technique:

In the upstream powder feeding system, powder is introduced into the gas flow at the converging section of the nozzle co-axially along with the nozzle central line. The basic structure of an upstream powder feeding cold spray system is described in U.S. Pat. No. 5,302,414 [1].

One of the common problems encountered in the operation of the upstream powder feeding systems is clogging of the nozzle, especially at the nozzle throat between the converging and diverging sections. Steenkiste et al. [4] disclosed a method to mitigate the problem of nozzle clogging during kinetic spray. It was suggested that a second particle population with either a larger average particle diameter or higher yield strength (hardness/elastic modulus) be mixed with the (first) particle population that is to be deposited. The mixture of the particles is accelerated such that the first particle population reaches a velocity that exceeds its critical velocity and is deposited on the substrate to form the desired coating, while the velocity of the second particle population is insufficient to cause its adherence on the substrate and/or the inside of the nozzle, thus avoiding nozzle clogging. In European Patent Publication 1630253, Zhao et al. [5] also suggested to incorporate an additional hard component into the spraying powder in order to prevent nozzle clogging.

In US Patent Publication No. US2005/0214474 [6], Han et al. disclose a nozzle design method for kinetic spray where a gas/powder conditioning chamber is inserted between the prior art powder/gas mixing chamber and the de Laval nozzle. This design was claimed to considerably increase the residence time of particles in the hot main stream gas, increasing the particle temperature and hence the deposition efficiency. Three (upstream) powder injection methods were suggested: (a) co-axial (in-line) with the axis of the conditioning chamber (the conventional method); (b) vertical (oblique) to the axis of the conditioning chamber; and (c) tangential (swirl) to the circumference of the cross-section of the conditioning chamber. Nevertheless, although methods (b) and (c) potentially increase particle temperatures, particle velocity at nozzle exit is lower than in the case of the (conventional) axial injection (method (a)).

US Patent Publication No. 2006/0201418 by Ko et al. [7] teaches the design of nozzle cross-section profiles (along the gas flow direction) and powder injection configurations to reduce/eliminate choking of nozzle throat. According to this disclosure, powder injection tube end is located coaxially in the throat region or in the outlet region beyond the throat area (the conventional diverging section). The proposed nozzle profiles along its axial cross-section do not have the conventional de Laval nozzle shapes.

Downstream Powder Feeding Technique:

In the downstream powder feeding system, the spray powder particles are introduced to the gas flow at a location down the stream after the throat of the nozzle (diverging portion). This configuration eliminates the need for an expensive high-pressure powder feeder. It also avoids the severe wear of the nozzle throat as occurs in the upstream feeding system, thus significantly simplifying the structure of the equipment. Because the spray powder particles are fed through the side of the nozzle in the diverging section where the gas temperature drops dramatically due to the volume expansion, inlet gas temperatures higher than the upstream powder feeding may be permitted to pre-heat the main working gas for increasing gas and particle velocities.

In U.S. Pat. No. 6,402,050 [8], Kashirin et al. discloses an apparatus for cold spray in which the outlet of a low-pressure powder feeder is connected to the diverging section of the nozzle through a conduit. Powder particles are injected radially into the gas stream in the nozzle by atmospheric air flow. In order to effectively transport the powder to the supersonic gas stream, the location for introducing the powder to the nozzle must be determined such that the cross-sectional areas of the supersonic nozzle at the juncture of the nozzle and the powder-feeder conduit is related to the throat area and the gas pressure at the nozzle inlet by a particular relationship.

In U.S. Pat. No. 7,143,967 [9], Heinrich et al. teaches a method for the introduction of spray powder particles coaxially and centrally within the de Laval nozzle not before the convergent section of the nozzle. In this configuration, the tube/nozzle carrying the powder particles passes through the pre-mixing and mixing chambers and the converging regions of the nozzle. US Patent Publication No. 2005/0040260 [10] by Zhao et al. also suggests the use of a coaxial powder injector tube passing through the throat into the diverging section of the nozzle. In this case, the injector tube passes through the centre hole of a gas collimator with surrounding holes. A low pressure powder feeder can be used for these powder feeding configurations.

US Patent Publication No. 2004/0058064 [11] and U.S. Pat. No. 7,108,893 [12], U.S. Pat. No. 6,811,812 [13] and U.S. Pat. No. 6,872,427 [14] disclose and apply a nozzle design method for kinetic spray and spray powder particles are introduced through one or more of a plurality of powder injection inlets located along the diverging section of the nozzle. The use of multiple powder injection points provides a means for more versatile adjusting and control of the spray process and coating quality.

U.S. Pat. No. 6,759,085 awarded to Muehlberger [15] describes a cold spray system that encloses the exit of the accelerated gas and particles from the spray nozzle inside a chamber where the pressure is controlled to much less than atmospheric pressure. This reduced ambient pressure results in substantially higher acceleration of gas and particles under similar static input gas pressures as compared with spraying in normal atmospheric pressures. In addition, an arrangement of valves and powder injection points is provided at various locations along the heating coil and within the spray nozzle to enable powder to be introduced at different selected locations. In this manner, heating of the powder and of the gas can be varied relative to each other to achieve various results.

The Japanese Patent Publication No. 2005-095886 [16] discloses a cold spray nozzle design methodology where the nozzle comprises a short divergent cone portion and a parallel wall extension portion. Powder with or without pre-heating is injected in the parallel extension tube portion at either single or plural locations/points. A low pressure powder feeder can be used.

In US Patent Publication No. 2007/0160769 [17], Maev et al. provide a cold spray gun that continuously measures the powder flow rate using a sensor and, based on this feed back information, either or both of the conveyance gas flow rate and the powder feed rate is/are adjusted so that a stable operation conditions are maintained. The application also suggests the use of axially-spaced multi-injection points for powder feeding downstream the gas flow for the convenience of changing feeding conditions.

In order to prevent adhesion/deposition of particles on nozzle walls, Shkodkin [18] proposed to apply cooling at the diverging portion of the nozzle for downstream powder feeding system. Haynes and Sanders [19] provided a method for preventing nozzle clogging in US Patent Publication No. US2004/0191449 by using polybenzimidazole (PBI) to fabricate at least the diverging portion of the nozzle. This material was found to have good properties of anti-adhesion by spray metal powders.

Polovtsev [31] and Kashirin et al. [32] disclose cold spray devices having two powder injectors where the powder feed injectors are disposed in the downstream portion of the nozzle opposite each other in the same cross section of the nozzle. The injectors are at an angle of 30° to 90° (31] or at angle of 90° [32] to the nozzle axis and the direction of flow. Such a paired powder injection arrangement helps the powder flow substantially along the nozzle centerline and hence reduces the probability of particle deposition/adhesion on the nozzle wall, thereby reducing nozzle clogging.

Comparison to Thermal Spray

In terms of gas and particle acceleration, there are certain similarities in apparatus configurations between the cold spray process and high velocity oxy-fuel (HVOF) thermal spray process. In modern HVOF systems (e.g. Thorpe et al. [22]), a combustion process generates high temperature and high pressure gas flow in a combustion chamber which exits through a nozzle/barrel that may have a de Laval type of shape including a converging and a diverging section. Powder materials are introduced to the hot gas flow in two major configurations: (a) axial powder injection and (b) radial powder injection. The powder is heated to either above or below its melting temperature. The radial powder injection configuration is mainly used in the high-pressure, kerosene-fueled systems. Multiple powder injectors are usually used in this configuration distributed around the circumference of the nozzle downstream of the combustor exit.

Limitations of Existing Technology

In cold spray, the supersonic jet flow is generated through a de Laval type nozzle. For upstream powder feeding cold spray systems, particles are injected axially into the flow at the inlet of the nozzle (upstream of the nozzle throat). Therefore, one of the drawbacks of this type of systems is that a high-pressure powder feeder has to be used running at a gas pressure higher than that in the main gas stream in order to avoid powder back flow. The high-pressure powder feeders are usually very bulky and are much more expensive (over ten times) than the currently commercially available low pressure powder feeders. Another major difficulty associated with these prior art upstream systems is that the de Laval nozzle always has very narrow throat that is prone to clog easily. Clogging becomes much more severe as the particle velocity and temperature are increased. Each combination of particle and nozzle material has a threshold critical velocity and temperature above which the particles will start to block the nozzle. For example, the critical temperature for spraying aluminum using a steel nozzle is approximately 290° C. and is approximately 200° C. for spraying tin using a steel nozzle. Therefore, the inlet gas temperature in the upstream system has to be restricted to certain level to avoid the overheating of powders, the clogging of the powder injector, and the clogging of the nozzle throat. Another drawback associated with the upstream system is the severe wear of nozzle throat due to particle erosion, which affects/modifies the nozzle operation conditions and leads to large variations in operating conditions and deposit quality. This is increasingly problematic when hard particles are being sprayed.

The methods proposed by Steenkiste et al. [4] and Zhao et al. [5] to incorporate a second population of either different material or different particle size into the spray powder mixture to prevent nozzle clogging are practically not feasible.

First of all, while the introduction of hard particles may prevent nozzle clogging, it significantly accelerates the nozzle wear. On the other hand, although the second population particles may not reach their critical conditions for forming deposit themselves, i.e., the very hard particles will not deform plastically while large particles (either soft or hard) will not reach their critical plastic deformation velocity required to form deposit on the substrate by themselves, these second population particles will get trapped and enclosed in the deposit/coating by the surrounding first population particles. As a result, a composite coating rather than a coating containing the only intended material of the first population particle will be obtained. This has been shown by the many published results, e.g. in [20], where metal matrix composite coatings are formed by spraying mixtures of metal and hard ceramic particles, although the hard ceramic particles can not deform and form deposit themselves.

The downstream powder feeding cold spray systems introduce the particles into the diverging portion of the nozzle (downstream of the nozzle throat) radially, which eliminates the need for complicated high-pressure powder feeders and thus significantly simplify the equipment. However, there are several shortcomings associated with the current designs of downstream systems. For example, current commercial downstream powder feeding cold spray systems are based on the teaching of U.S. Pat. No. 6,402,050 [8], where powder feeding relies on atmospheric pressure and the siphon effect of the main gas flow in the nozzle. To get adequate powder feeding, the location of powder injection on the nozzle must be coordinated with the inlet gas pressure and the nozzle design is restricted to relatively low exit Mach number (usually <3). Variations on the operating parameters are thus limited once the nozzle design is determined. In addition, there is a maximum inlet gas pressure (normally <1 MPa) that such systems can use, over which the atmospheric pressure will no longer be able to supply powders into the nozzle. As a result, only relatively low particle velocities can be reached through the downstream powder feeding technique.

In US Patent Publication No. 2004/0058064 [11] and U.S. Pat. No. 7,108,893 [12], U.S. Pat. No. 6,811,812 [13], U.S. Pat. No. 6,759,085 [15], and U.S. Pat. No. 6,872,427 [14], use of commercially available powder feeders has been suggested. Proper design, downstream powder feeding systems with pressurized powder feeders potentially allows the use of increased main gas pressures and temperatures and leads to significantly improved particle velocities while still maintaining the advantages of low cost and portability. However, no relationships have so far been defined in the prior art in coordinating pressurized powder feeding with the other operation parameters such as inlet gas pressure and the configurations of the nozzle. Without clear understanding of relationships among all the operating parameters, a stable cold spray process cannot be created. The concept of using multiple powder injection points along the nozzle length provided in the US Patent Publications No. 2004/0058064 [11] and No. 2007/0160769 [17] and U.S. Pat. No. 7,108,893 [12], U.S. Pat. No. 6,811,812 [13], U.S. Pat. No. 6,759,085 [15], and U.S. Pat. No. 6,872,427 [14] does offer increased flexibility over conventional designs.

However, all the methods for the use of a powder feeder to introduce powder particles radially also cause sidewall erosion of the nozzle opposite the point of powder introduction, especially when hard materials are sprayed [10]. In some cases, the edges of the spray path produced by this method are saw-toothed. When relatively soft materials are sprayed or when inadequate processing parameters such as too high processing temperatures and/or pressures are used, adhesion/deposition of the spray materials on sidewalls of the nozzle occurs.

In the powder feeding configurations proposed by Heinrich et al. [9] and Zhao et al. [10], particles are co-axially injected to the downstream gas flow with an injector tube passing through the nozzle throat. At the end of the powder injector tube, there is a sudden change in effective main gas flow cross-section area, i.e., a sudden change in the Mach number. This can lead to considerable gas flow disturbance. Meanwhile, the gap becomes very narrow at the throat, especially for relatively small throat areas and not small enough injector tubes. For example, to obtain a throat cross-section area equivalent to a throat diameter of 2 mm in the conventional nozzle configurations with an injector tube outer diameter of 2 mm, the gap between the injector tube and the nozzle throat is only 0.4 mm. Considerable gas flow friction will occur through such narrow gaps. In addition, any slight misalignment will result in huge imbalance/disturbance in the downstream gas flow. It may even become impossible to maintain stable supersonic flow. US Patent Publication No. 2006/0201418 by Ko et al. [7] has the similar shortcomings and limitations.

Using PBI to fabricate nozzle as proposed in US Patent Publication No. US2004/0191449 [19] may alleviate the nozzle clogging problem; however, the upper working temperature of the material is only 240-400° C. and its wear resistance is not good enough for stable practical applications.

While the apparatuses of Polovtsev [31] and Kashirin et al. [32] address the nozzle clogging problem, another problem arises. In experiments conducted by the present Applicants, it has been found that the cross-sectional area (related to inner diameter) of each powder injector at the junction with the nozzle inner wall must be small enough so that substantial turbulent flow or even shock waves in the main gas flow are prevented. Otherwise, significant reduction of particle velocity and deposition efficiency may occur. However, powder injectors with such small cross-sectional areas are found to be very prone to blocking/jamming by powders, especially at startup and shutdown of the spray operation. The problem becomes more severe at increased working gas pressures. Jamming occurred at every system startup and shutting down.

With regard to HVOF there are significant differences between downstream cold spray processes and HVOF. In the HVOF process, solid particles are heated to considerably higher temperatures (molten or partly molten state) than in the cold spray process. Particle heating is a much more important consideration in HVOF than in the cold spray process, although heating of particles can also be beneficial in cold spray. In cold spray, the major purpose of heating the gas is to increase gas and particle velocities rather than to melt or partially melt the particles as in HVOF. The nozzle diameters in HVOF systems are generally much larger (about 8 mm, for example) [23] than those used in the cold spray process which are generally in the order of 2-4 mm. Thus, clogging and nozzle erosion is generally not a major issue in the HVOF process. The major consideration for using multi-port powder injection in the radial injection HVOF system is to achieve more uniform powder loading in the exit hot gas stream, more efficient use of the available heat and hence substantially higher spray rates than the axial powder injection version of HVOF. There is no teaching in the prior art of HVOF regarding the elimination of nozzle clogging and erosion or the promotion of better gas flow patterns within the nozzle by using such radial powder injection configurations. Further, since HVOF is based on the combustion of an oxy fuel to provide pressurized gas, relationships between the pressure of the gas and the injection pressure of the powder are not the same. Thus, it would not be apparent that configurations successfully used in HVOF systems would be applicable to downstream cold spray systems.

It is thus apparent that the prior art downstream powder feeding cold spray systems are not satisfactory in achieving high particle velocities to produce reliable and consistent deposition with high quality. Further improvement is necessary. It is thus highly desirable to develop an improved cold spray technology that incorporates the advantages of both existing techniques but avoids their disadvantages. There is a need for cold spray technology having deposition capabilities similar to high pressure upstream techniques while being portable, less expensive and easy to maintain and operate.

SUMMARY OF THE INVENTION

There is provided a system for cold gas dynamic spraying of particulate material comprising: a nozzle having a substantially linear flow path from a first end to a second end, the linear flow path having a cross-sectional area that converges from the first end to a throat of minimum cross-sectional area and diverges from the throat to the second end, a working gas inlet proximal the first end to permit working gas to enter the flow path substantially parallel to the flow path of the nozzle, two or more particle inlets at a location between the throat and the second end to permit particulate material to enter the flow path of the nozzle at the location, the two or more particle inlets arranged symmetrically around the flow path of the nozzle, the two or more particle inlets having particle flow paths therein that are radial to the flow path of the nozzle, and an outlet at the second end through which the particulate material exits the nozzle, substantially all of the particulate material being in solid phase when exiting the nozzle; one or more non-combustion sources of pressurized working gas in fluid communication with the working gas inlet; one or more sources of the particulate material in particle flow communication with the two or more particle inlets; and, means for clearing the two or more particle inlets of residual particulate material when the system is not spraying the particulate material out the nozzle.

There is further provided method of cold gas dynamic spraying of particulate material comprising: providing a flow of pressurized working gas from a non-combustion source; introducing the flow of pressurized working gas into a nozzle substantially parallel to a linear flow path therein, the linear flow path having a cross-sectional area that converges from a first end of the nozzle to a throat of minimum cross-sectional area and diverges from the throat to a second end of the nozzle; providing a controlled flow of pressurized carrier gas to a source of particulate material and injecting the particulate material into the flow path in two or more streams, the two or more streams entering the flow path at two or more points symmetrically disposed around the flow path and at a location between the throat and the second end of the nozzle, the working gas carrying the injected particulate material along the flow path to an outlet at the second end; controlling pressure of the carrier gas to provide a stable particulate material injection pressure before and during introduction of the working gas into the nozzle; and, ejecting the particulate material from the nozzle through the outlet, substantially all of the particulate material being in solid phase when exiting the nozzle.

There is yet further provided a nozzle for spraying particulate material, the nozzle comprising: a substantially linear flow path from a first end to a second end; a working gas inlet proximal the first end to permit working gas to enter the flow path substantially parallel to the flow path of the nozzle; one or more particle inlets between the first end and second end to permit particulate material to enter the flow path of the nozzle; a cross-sectional shape between the one or more particle inlets and the second end having a narrower middle section than edge sections; and, an outlet at the second end through which the particulate material exits the nozzle.

The nozzle is preferably a converging-diverging de Laval type nozzle. Cross-sectional shape of the nozzle can be any suitable shape and may be selected for obtaining a desired deposit profile. Cross-sectional shapes include, for example, circular shapes or non-circular shapes (e.g. oval, rectangular, square or irregular shapes). In a particularly advantageous aspect of the present invention, the nozzle has a cross-sectional shape between the particle inlets and the outlet that is narrower in a middle section compared to edge sections. Such a cross-sectional shape for the nozzle ultimately provides coatings with superior cross-sectional profiles for many applications.

At the throat of the nozzle, minimum cross-sectional area is preferably in a range of about 0.2-33 $mm^2$, for example about 0.8-12 $mm^2$ or about 3-7 $mm^2$. For circular cross-sections, minimum diameter at the throat is preferably in a range of about 0.5-6.5 mm, for example about 1-6 mm or about 1.5-4 mm or about 1-4 mm or about 2-4 mm or about 2-3 mm. Cross-sectional area of the nozzle at the first end is not critical as long as it is greater than the cross-sectional area at the throat, and is typically at least about 4 times the cross-sectional area at the throat. The cross-sectional area of the nozzle at the second end (outlet) is generally determined by the intended nozzle exit Mach number which is generally greater than 1. Exit Mach number is determined by the ratio of nozzle area at the second end (outlet) to that at the throat. In the present invention, Mach numbers greater than 4, for example 5, 6, 7 or even higher, are achievable.

Nozzle length may be about 100 mm or longer. However, an advantage of the present invention is that longer nozzle lengths may be employed, for example about 150 mm or longer or about 200 mm or longer. A nozzle length in a range of from 150-400 mm or from 200-400 mm may be mentioned specifically. Longer nozzles are beneficial for accelerating particles. However, prior art downstream systems that try to employ nozzles of great length are prone to nozzle clogging and/or sidewall erosion. Systems of the present invention reduce the possibility of clogging and erosion even for very long nozzle lengths.

Two or more particle inlets at a location between the throat and the second end permit particulate material to enter the flow path of the nozzle at a location. In a de Laval type nozzle, the location is at the diverging portion of the nozzle. The flow path is substantially linear and describes the main gas flow direction through the nozzle. The two or more particle inlets have inner diameters at the junction with the inner wall of the nozzle that are smaller than the inner diameter of a particle inlet used in a system having only one particle inlet. There exists an optimal operational range for the ratio between the total cross-sectional area of particle inlets and the cross-sectional area of the nozzle at the location of the particle inlets on the nozzle. Particle inlets with cross-sectional areas that are too small are easily clogged during the cold spray process, especially during starting and stopping of particle feeding. In addition, particle inlets that are too small can limit spray efficiency (limiting the maximum system capability for particle delivery). On the other hand, particle inlets having cross-sectional areas that are too large can cause turbulent flow in the nozzle, significantly reducing particle velocity and deposition efficiency.

Thus, the ratio between total cross-sectional area of particle inlets and the cross-sectional area of the nozzle is preferably in a range of from about 0.04 to about 0.25, where the particle inlets are disposed surrounding the periphery of the nozzle at the same distance from the nozzle throat. The total cross-sectional area of the particle inlets is the sum of the cross-sectional area of each of the individual particle inlets. Preferably, the individual particle inlets have the same cross-sectional area. Additionally, to minimize blocking of particle inlets, the minimum inner cross-sectional area of each individual particle inlet where the inlet meets the nozzle is preferably no less than about 0.10 $mm^2$ (about 0.36 mm in diameter for circular particle inlets), more preferably no less than about 0.12 $mm^2$ (about 0.4 mm in diameter for circular particle inlets).

The two or more particle inlets are arranged around the circumference of the nozzle symmetrically around the flow path at one location along the length of the nozzle. The two or more particle inlets may be, for example, two, three, four, five, six, seven, eight or more. Further, there may be one or more sets of particle inlets disposed along the length of the nozzle at different locations between the throat and the second end. If more than one set is desired, there may be two or more sets, for example, two, three, four, five, six, seven, eight, nine, ten or more sets of the two or more particle inlets. Such arrangements of particle inlets advantageously reduce or eliminate erosion of nozzle sidewalls, while achieving more uniform particle density distributions over the nozzle cross-section at the outlet. Such arrangements also advantageously allow, by controlling the amount or initial velocity (pressure difference) of powders fed into each inlet, the manipulation of the particle density and velocity distribution at the outlet and, therefore, the adjustment of deposit shape. Such arrangements also permit control over the types of particulate materials fed into each individual inlet thereby permitting the deposit of composite as well as functionally graded materials.

The two or more particle inlets have particle flow paths that are radial to the flow path of the nozzle. Thus, particles are fed into the flow path at an angle that is not parallel to the flow path of the gas traveling down the nozzle. This angle may be 90° (i.e. perpendicular) to the flow path, or some non-zero angle between 0° and 90°. This angle may be from about 5° to about 85°, from about 10° to about 80° or from about 30° to about 60°, for example about 45°. Particles may be fed into the flow path from the particle inlets so that the particles are fed through a centerline of the flow path, or along a tangential direction of an interior wall of the nozzle.

Angled particle inlets enable powder particles under atmospheric pressure to be drawn into the main gas flow in the nozzle even at relatively high inlet gas pressure. Under pressurized particle feeding conditions, such a design helps the powder particles to be easily injected into the main gas stream while minimizing energy loss. This design helps alleviate problems relevant to nozzle erosion and clogging, especially when working under high pressure and temperature when a slight asymmetry exists in the arrangement of the two or more particle inlets. Such design also helps to increase particle populations near the nozzle circumference, leading to more uniform particle density distributions across the nozzle cross-section.

Advantageously, pressurized powder particle feeding (with the use of a carrier gas) and high inlet working gas pressure may be used in the present invention allowing higher exit Mach number, leading to higher particle exit velocities and better particle deposition on a substrate. Proper coordination of particle feeding pressure and working gas pressure at their respective inlets can maximize exit particle velocity at the outlet while maintaining the other benefits of the present invention.

Pressurized particle feeding is more beneficial than simply depending on the siphon effect of the gas flow in the nozzle because this allows the use of higher inlet working gas pressures. Compared to upstream systems that require special high pressure powder feeders, commercially available low cost powder feeders with relatively low working pressure, for example about 0.2-0.8 MPa (30 to 110 psi) can be used for this purpose. The axis-symmetric particle inlets, helped by angling the particle inlets, can reduce or eliminate nozzle erosion and clogging problems associated with high working pressure and temperature.

Pressurized particle feeding usable in the present invention enables a substantial increase in inlet working gas pressure from about 0.8 MPa for a typical downstream system to a pressure as high as about 4 MPa (currently used in the most advanced upstream system) or even higher. Inlet working gas pressure may even be much higher than in existing upstream systems since high pressure powder feeders are not required. Therefore, downstream systems and methods of the present invention can even lead to significantly higher exit particle velocities than in existing upstream systems, let alone existing downstream systems. Exit Mach numbers can be increased from less than 3 for existing downstream systems to larger than 4, which is higher than is used in existing upstream systems. Not only are the benefits of both upstream and downstream cold spray systems realized by the systems and methods of the present invention, the present invention is superior to existing systems for both.

With pressurized particle feeding, coordinating pressurized particle feeding with the other operation parameters (such as inlet gas pressure and configurations of the nozzle) becomes important. For a given configurations of the de Laval nozzle, particle feeding pressure is adjusted according to inlet working gas pressure. If particle feeding pressure is too low, no particles or few particles will be injected into the flow path of the nozzle, leading to unstable powder feeding and even complete jamming of the powder feeder. Too high of a particle feeding pressure will introduce too much carrier gas that will significantly reduce velocity and also cause turbulence in the working gas flow in the nozzle thereby significantly reducing exit particle velocity at the outlet. Too high of a particle feeding pressure will also increase the probability of particle adhesion/deposition on or erosion of the sidewall of the nozzle as a result of injected particle overshoot.

Advantageously, the present invention provides a relationship for coordinating particle feeding pressure with the inlet working gas pressure for various configurations of the nozzle to contribute to stable operation of the present cold spray system and method. Any suitable working gas from a non-combustion source may be used, for example, air, nitrogen, helium, argon, steam, hydrogen or any mixture thereof. Air, nitrogen or a mixture thereof is preferred.

Equation (Z) provides the advantageous relationship between the pressure of the carrier gas carrying the particulate material at the particle inlets ($P_{inj}$) and the pressure of the working gas ($P_0$) at the working gas inlet.

$$\frac{P_0}{P_{inj}} \le a\left(\frac{A_{inj}}{A^*}\right)^2 + b\left(\frac{A_{inj}}{A^*}\right) + c \quad (Z)$$

where $P_{inj}$ is greater than atmospheric pressure, A* is the minimum cross-sectional area of the throat, $A_{inj}$ is cross-sectional area of the nozzle at the location of the particle inlets, $0 \le a \le 5.0$, $2.0 \le b \le 10.0$, and $-15.0 \le c \le -2.0$. Preferably, $0.8 \le a \le 2.5$, $5.0 \le b \le 8.0$, and $-10.0 \le c \le -4.0$. The values of a, b and c depend on the type of working gas. For example, for helium a, b and c are preferably 2.3, 5.6 and −6.2, respectively. For air or nitrogen a, b and c are preferably 0.87, 6.1 and −5.5, respectively.

The present invention also permits the use of higher working gas temperature at the working gas inlet than in existing cold spray systems without inducing throat clogging or erosion, while maintaining local gas temperatures in the nozzle at the particle inlets which are similar to existing upstream cold spray systems. Working gas temperature at the working gas inlet may be, for example, about 25° C. or higher, even about 500° C. or higher, even about 800° C. or higher, even about 1200° C. or higher. Prior art cold spray systems are typically unable to accommodate working gas inlet temperatures greater than about 500° C., although a few systems have been reported that can accommodate working gas inlet temperatures up to less than about 800° C. Increased working gas inlet temperature permits a further increase in exit particle velocities even over velocities possible with existing upstream cold spray systems. The actual allowable temperatures depend on the type of particles being sprayed. Any suitable gas heater may be used. A plurality of heaters may be used to heat the working gas in stages. A plurality of heaters advantageously increases portability and reduces installation cost as each individual heater may be lighter with lower power requirements thereby being able to utilize standard power supplies. One of the heaters may be installed directly on a hand-held spray gun.

Particles may be pre-heated before feeding into the nozzle to improve formability of the particles resulting in better quality coating during subsequent deposition. The pre-heating temperature depends on the type of particulate material. According to physical metallurgy, in the case of metals, most metals will start to significantly soften at half of the absolute melting temperature ($T_{mpt}$) of the metal. A pre-heating temperature of from less than about 0.9 $T_{mpt}$ is desirable, for example less than about 0.7 $T_{mpt}$. If the pre-heating temperature is too high, undesirable particle melting/partial melting, particle oxidation and/or particle adhesion/deposition to the nozzle sidewall may occur. A pre-heating temperature of from about 0.5-0.9 $T_{mpt}$, for example 0.5-0.7 $T_{mpt}$, takes advantage of the plasticization effect due to the softening of the material. A pre-heating temperature of less than about 0.5 $T_{mpt}$ better avoids the possibility of undesirable particle oxidation and/or adhesion/deposition to the nozzle sidewall. The actual allowable temperature to which the particles may be pre-heated depends on the type of particles being sprayed. The particles should not be heated so much as to melt or partially melt them. Any suitable particle heater or plurality of heaters may be used.

As has been previously discussed, prior art cold spray apparatuses having two particle injectors (Polovtsev [31] and Kashirin et al. [32]) have encountered problems with jamming of the injectors. This is a serious problem hindering the use of pressurized particle feeders and of multiple particle injectors as disclosed in Polovtsev [31] and Kashirin et al. [32]. It has now been found that this problem can be resolved by one or a combination of the following.

When starting a spray operation, working gas pressure may be increased slowly so that carrier gas pressure for particle feed is gradually built up in the particle feed system to a level that is sufficient to keep a predetermined carrier gas flow rate. If this coordination is not properly maintained, particle flow into the nozzle is slowed and can even be momentarily stopped, which will lead to the sedimentation of particles in particle feed lines, thereby blocking/jamming the particle inlets.

When stopping the spray operation, the particle feed rate may be first adjusted to a level close to zero while still maintaining the original flow rates for both the carrier gas and the working gas. The working gas flow may be switched off after the new set particle feed rate (close to zero) has been reached and the majority of the particles already in the particle feed lines have been cleared and fed into the nozzle. Finally, particle feed is stopped altogether when the working gas pressure has dropped to below approximately 120 psi where a negative pressure against the atmospheric pressure is developed in the nozzle. If this procedure is not followed, that is, if the working gas flow is stopped before purging all the particles in the particle feed line, then the sudden pressure drop in the nozzle (at the particle injection location) causes a rapid/pulsed flow of residual particles in the particle feed lines, thereby and blocking/jamming the particle inlets.

The above starting and stopping procedures substantially reduce the probability of blocking/jamming of particle injectors. However, they can be tedious, unreliable and difficult to execute in practice.

As an alternative to the above, it has now been found that controlling carrier gas pressures at all times in the particle feed system in accordance with equation Z above permits reduces the probability of particle sedimentation and blocking/jamming of the particle inlets. Several types of powder feed systems are commercially available that are suitable for applications in downstream powder feed cold spray. Although the principles for particle feed rate control differ for each type of particle feeder, they all rely on a carrier gas to transport rationed particles. Generally, a flow rate of carrier gas is either pre-set at some constant value or is dynamically adjusted to maintain a pre-determined particle feed rate. However, the carrier gas pressure is generally set at the source but is not controlled and will fluctuate based on the ambient pressure at the exit of the particle feed lines to maintain a constant pressure difference and controlled carrier gas flow rate. This carrier pressure adjustment and its effect usually have a time delay, especially considering the compressible nature of gases. For many operations such as in thermal spray, this time delay is not critical. However, for cold spray applications which use small cross-sectional area powder injectors, the time delay can cause pulsed particle flow that leads to the blocking/jamming of the particle injectors, as has been discussed above.

To reduce blocking/jamming of particle injectors due to the delayed carrier gas pressure response when sudden ambient pressure change occurs in the particle inlet at the juncture with the nozzle, a pressure regulator, preferably an automated pressure regulator, may be attached to the particle feeding system, most conveniently to the source of particulate material, that allows precise control of carrier gas pressure to realize a stable injection pressure, $P_{inj}$, as defined in equation (Z) before and during introduction of the working gas in the nozzle. The carrier gas pressure at the particle feeder, $P_{feeder}$, is controlled to realize an injection pressure, $P_{inj}$, as defined in equation (Z) before and during the operation feeder may be slightly higher than the injection pressure, $P_{inj}$, to overcome the pressure loss, $\Delta P_{loss}$, along the particle feed lines.

It is very advantageous to pre-pressurize the carrier gas according to equation (Z) before the working gas pressure is introduced to the nozzle. By pre-pressurizing the particle feed system and maintaining the carrier gas pressure according to equation (Z), sedimentation and accumulation of particles in the small regions of the particle inlets due to substantial slowing and/or stopping of particle flow are reduced or prevented, even when sudden pressure changes occur in the working gas flow within the nozzle such as during start up and shut down of the spray operation.

Further, it has now been advantageously found that clearing residual particles from particle inlets (and particle feed lines) after operation of the cold spray system helps reduce blocking/jamming of the particle inlets. Clearing residual particles after a cold spray operation may be advantageously accomplished using a pressure sink in fluid communication with the particle inlets. The pressure sink may provide a volume of decrease pressure to draw particles out of the particle inlets and/or particle feed lines, or may provide an increased pressure to blow particles out of the particle inlets. It is preferable to use decreased pressure to draw particles out as this is the reverse direction of the carrier gas flow during operation of the cold spray system.

In one embodiment, an additional gas flow path may be provided for each particle feed line that communicates, on one end, with the particle feed line linked to a particle injector, and, on the other end, with a pressure sink. In this embodiment, the pressure sink is any space or device where pressure is maintained at no greater than the atmospheric pressure. Means may be provided to open and close the communication between the particle feed lines and the pressure sink, for example valves. During normal cold spray operation, communication between particle feed lines and the pressure sink is closed, with particles being injected into the spray nozzle through particle inlets. When the spray operation is to be stopped, the pressure sink is formed and the communication between the particle feed lines and the pressure sink is opened (for example by opening the valves between the particle feed lines and the pressure sink). Thus, particles in the particle feed lines, including those in the particle inlets, are drawn out into the pressure sink where negative pressure is maintained relative to both the pressure in the particle feed system and the pressure in the nozzle at the particle inlet locations. Under such conditions, the working gas flow can be switched off safely without causing blocking/jamming of the particle inlets.

The pressure sink can be formed by any suitable means, for example, by forming a high-speed gas flow (jet) in, for example, a nozzle. Flow of compressed gas through a venture creates a negative pressure that is below atmospheric pressure. When the particle feed line and the pressure sink are in fluid communication, residual particles in the particle feed system are drawn into the pressure sink. Means for controlling fluid communication between the particle feed lines and the pressure sink can be manually operated but are more advantageously operated by electro-mechanical means, for example solenoid shut-off valves and/or pinch solenoid valves. The operation of these means can also be integrated into the working gas flow control circuit, whereby shutting off the working gas flow triggers a coordinated automatic particle clearing operation.

The implementation of one or a combination of the above measures effectively reduces blocking of particle inlets and facilitates automation of the cold spray operation, making it possible to take the advantages of using pressurized particle feeders and multiple/paired particle inlets for downstream cold spray systems.

The system and method of the present invention may be used to spray any type of particles or mixture of particles, for example metals and metal alloys, organic polymers, ceramics, composites thereof and mixtures thereof. Metals include, for example, Al, Mg, Ti, Cu, Fe, Ni, Zn, V, Ta, Au, Ag, Co, Zr, Sn, Nb, Mo, Pb, W and mixtures thereof. Metal alloys include, for example, steel (e.g. stainless steel), Ni-based alloys (e.g. Inconels™), Ti-based alloys (e.g. Ti6Al4V), Al-based alloys (e.g. Al4047), MCrAlYs (metal chromium aluminum yttrium alloys, where M is another metal) and mixtures thereof. The present system and method are particularly advantageous for spraying and depositing material comprising oxygen-sensitive materials (e.g. Al, Ti, Cu, Fe, etc.), temperature sensitive materials (e.g. nano-structured, amorphous materials, organic polymers, etc.) and/or phase-sensitive materials (e.g. carbide composites, intermetallics, etc.). Particles of various sizes may be sprayed. Preferably, average particle diameter is about 1-200 μm, for example about 5-100 μm.

Downstream cold spray systems and methods of the present invention retain the low cost and portability of existing downstream cold spray systems while having as good or superior particle exit velocities compared with existing upstream cold spray systems, while reducing or eliminating clogging and erosion problems associated with upstream systems. The very high particle exit velocities advantageously permit the use of low cost air or nitrogen as opposed to the more expensive helium as the working gas.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1:
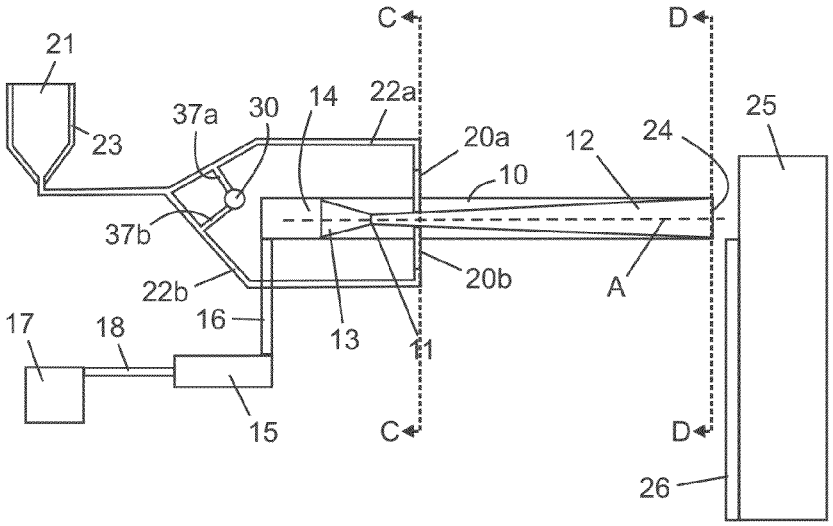
FIG. 1 is a schematic diagram of an embodiment of a downstream cold spray system of the present invention having two radial particle injection inlets symmetrically arranged around nozzle flow path and a pressure sink for clearing the particle injection inlets.

Referring to FIG. 1, one embodiment of a downstream cold spray system of the present invention having two radial particle injection inlets symmetrically arranged around nozzle flow path is shown with a pressure sink for clearing the particle injection inlets. De Laval nozzle 10 comprises throat 11 of minimum cross-sectional area, diverging region 12 and converging region 13. Working gas inlet 14 is in fluid communication with the converging region such that pressurized working gas flows into the nozzle along a flow path A parallel to the length of the nozzle. Working gas inlet 14 is in fluid communication with working gas heater 15 through conduit 16. Working gas heater 15 is in fluid communication with pressurized working gas source 17 through conduit 18. Particulate material is injected into flow path A of nozzle 10 at an angle of 90° to the flow path through two radial particle injectors 20*a* and 20*b*. Where the particle injectors meet the nozzle, the ratio of the total area of the particle injectors to the area of the nozzle is equal to 0.05 (i.e. each injector has an inner diameter of 0.7 mm and the nozzle has an inner diameter of 4.4 mm at the injection location). The particle injectors are arranged directly opposite each other such that injected particles meet at a centerline of the flow path. Particles are received by injectors 20*a* and 20*b* through particle feed lines 22*a* and 22*b* from pressurized particle source 21 equipped with heater 23. Particles entrained in the working gas are carried down the diverging region 12 of the nozzle and are sprayed through outlet 24 on to substrate 25 where coating 26 is formed. Pressure sink 30 for clearing residual particles from particle inlets after a spray operation is in fluid communication with particle feed lines 22*a* and 22*b* through clear-out lines 37*a* and 37*b*. Clear-out lines 37*a* and 37*b* are shown closer to particle source 21 than to particle injectors 20*a* and 20*b* for convenience of illustration, however, it is usually better to have the clear-out lines in fluid communication with the particle feed lines at points closer to the particle injectors. The pressure sink and its operation are described in more detail in connection with FIG. 5.

Figure 2:
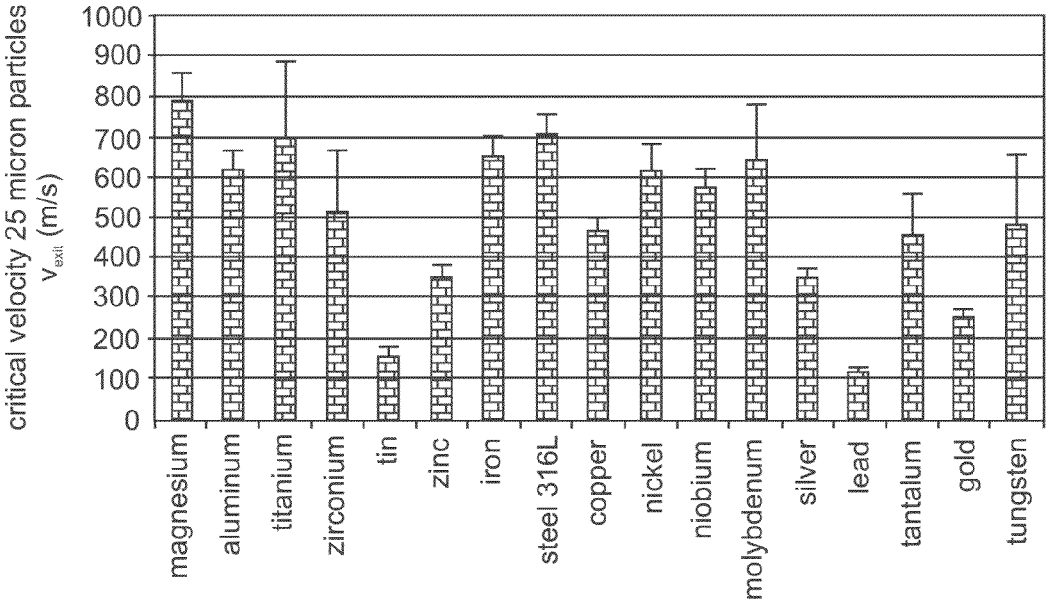
FIG. 2 is a graph depicting calculated critical velocity (m/s) for deposition of 25 μm particles of different materials using cold spray deposition.

Referring to FIG. 2, various types of particulate material may be sprayed using the system or method of the present invention. These include, for example, materials comprising magnesium, aluminum, titanium, zirconium, tin, zinc, iron, steel, copper, nickel, niobium, molybdenum, silver, lead, tantalum, gold and tungsten. Different materials require different critical velocities to be successfully deposited on a substrate by cold spray technology. FIG. 2 is a graph depicting calculated critical velocity (m/s) for deposition of 25 μm particles of different materials that may be sprayed and deposited using cold spray deposition [27]. Error bars indicate a range of uncertainty with respect to the range of available materials data.

Referring to FIGS. 3A-F, end views of nozzles are shown having various symmetric arrangements of particle inlets at one location along the length of the nozzle on the diverging portion.

Figure 3A:
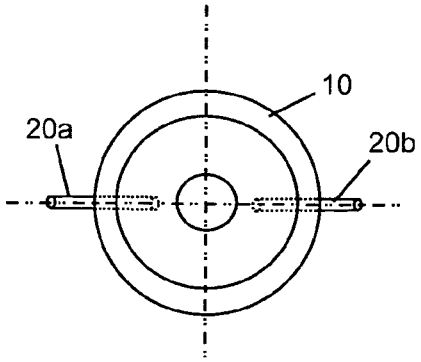
FIG. 3A-F are schematic diagrams showing views through cross-section C-C of FIG. 1 of nozzles having various symmetric arrangements of particle inlets.
Figure 3B:
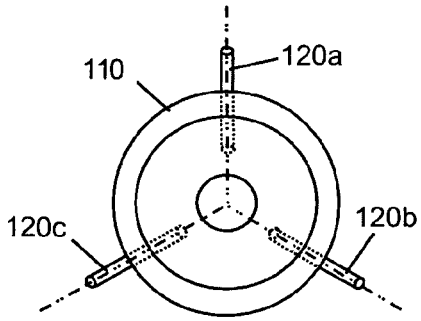
Figure 3C:
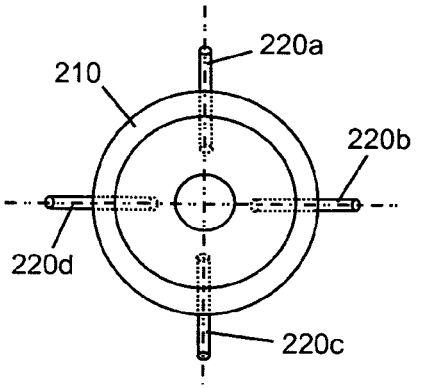
Figure 3D:
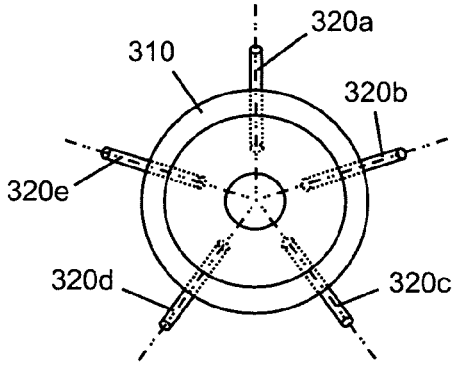
Figure 3E:
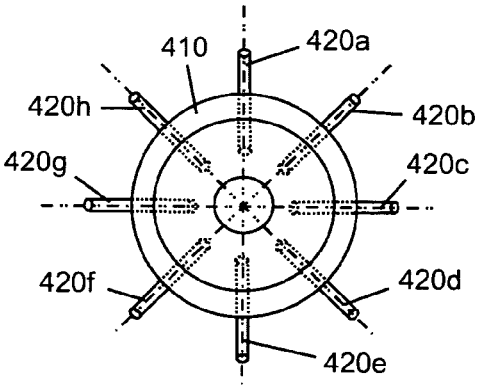
Figure 3F:
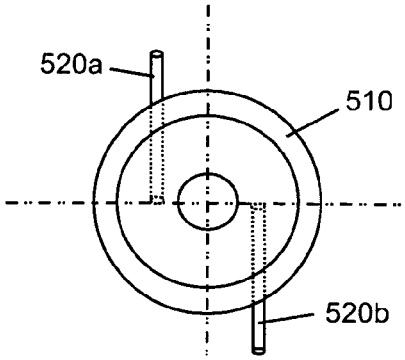

FIG. 3A shows nozzle 10 having two particle inlets 20*a* and 20*b* in an arrangement as depicted in FIG. 1. The inlets are at the same location along the length of the nozzle but are oriented 180° across from each other on opposite sides of the nozzle's circumference resulting in two-fold symmetry around the flow path of the nozzle. FIG. 3B shows nozzle 110 having three particle inlets 120*a*, 120*b* and 120*c* in a three-fold symmetrical arrangement around the flow path. FIG. 3C shows nozzle 210 having four particle inlets 220*a*, 220*b*, 220*c* and 220*d* in a four-fold symmetrical arrangement around the flow path. FIG. 3D shows nozzle 310 having five particle inlets 320*a*, 320*b*, 320*c*, 320*d* and 320*e* in a five-fold symmetrical arrangement around the flow path. FIG. 3E shows nozzle 410 having eight particle inlets 420*a*, 420*b*, 420*c*, 420*d*, 420*e*, 420*f*, 420*g* and 420*h* in a eight-fold symmetrical arrangement around the flow path. While FIGS. 3A-E all show arrangements where the particle flow paths from the inlets meet at the centerline of the nozzle's flow path, FIG. 3F depicts a symmetrical inlet arrangement around nozzle 510 in which two particle inlets 520*a* and 520*b* permit flow of particles into the flow path at a tangent to the nozzle's sidewall.

Figure 4:
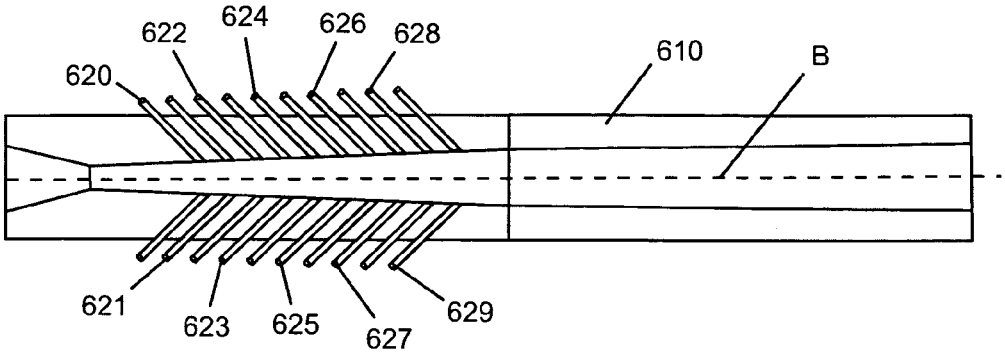
FIG. 4 is a schematic diagram of a de Laval nozzle having ten sets of two symmetrically arranged particle inlets disposed along the length of the nozzle with the particle inlets at an angle of 45° with respect to the flow path of the nozzle.

Referring to FIG. 4, a cold spray system can have more than one set of symmetrically arranged particle inlets and/or the particle inlets may be at oblique angles with respect to the direction of the flow path in the nozzle. De Laval nozzle 610 with flow path B has ten sets (620-629) of two particle inlets along the diverging portion of the nozzle. The particle inlets are angled at an angle of 45° to the flow path of the nozzle.

Figure 5:
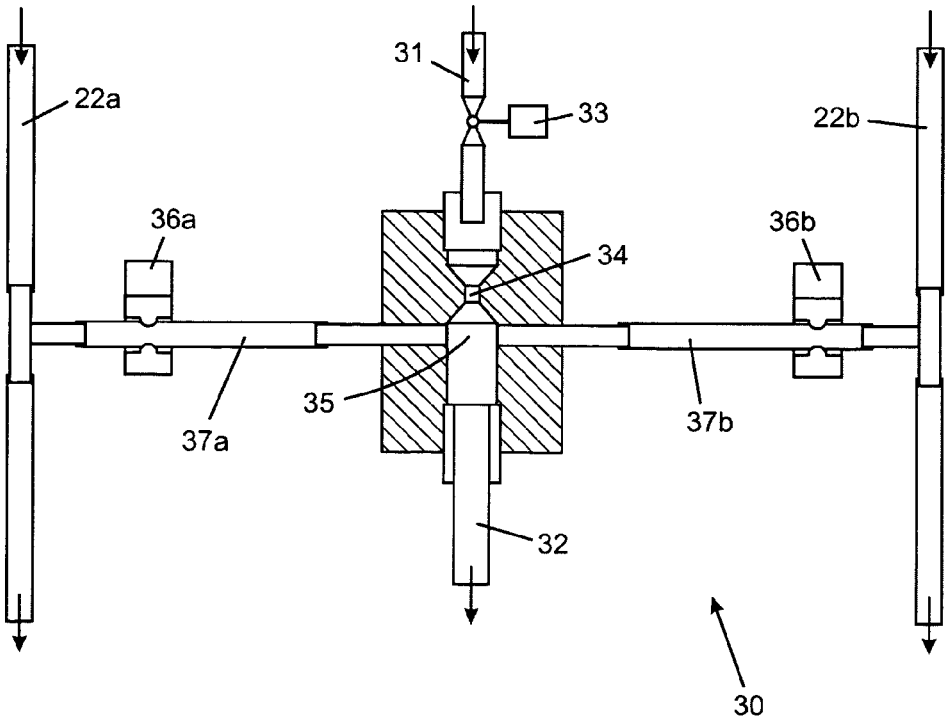
FIG. 5 is a schematic diagram of an embodiment of a pressure sink for clearing particle inlets.

Referring to FIG. 5, one embodiment of a pressure sink is illustrated in which reduced pressure is used to draw particles out of particle injection inlets and particle feed lines, thereby clearing the particle inlets. Thus, pressure sink 30 comprises compressed gas line 31 for carrying compressed gas to venturi 34. The compressed gas passes through venturi 34 and expands into chamber 35 with a concomitant drop in pressure in the chamber. The compressed gas exits the pressure sink through exhaust port 32. Solenoid valve 33 is used to control compressed gas flow into the venturi. Clear-out lines 37*a* and 37*b* are in fluid communication with particle feed lines 22*a* and 22*b*, respectively, and with chamber 35. Solenoid pinch valves 36*a* and 36*b* on clear-out lines 37*a* and 37*b* are used to control communication between the particle feed lines and the chamber 35.

When the cold spray system is in operation, solenoid pinch valves 36*a* and 36*b* are closed and solenoid valve 33 is also closed. Particles from the particle source flow through particle feed lines 22*a* and 22*b* to the particle injection inlets in the direction of the arrows. Once the spray operation is over, it is desirable to clear the particle injection inlets of any remaining particles. To accomplish this, particle flow from the particle source in the particle feed lines is stopped and solenoid valve 33 is opened to allow flow of compressed gas through venturi 34, which results in a reduced pressure zone in chamber 35. Solenoid pinch valves 36*a* and 36*b* are then opened and particles in the particle feed lines, and thus particles in the particle injection inlets are drawn through clear-out lines 37*a* and 37*b* into chamber 35 and then expelled through exhaust port 32 by the flow of compressed gas.

Example 1

Numerical Modeling and Verification for Cold Spray System Performance

In order to simulate the performance of cold spray systems to better compare systems of the present invention to systems of the prior art, a numerical model was developed and verified.

Parameters Involved in Simulation

A typical de Laval type nozzle is used having a converging cone whose diameter decreases from 8.2 mm at the entrance to 2.5 mm at the throat. Downstream of the throat region is a diverging cone with a diameter of 4.88 mm at the outlet end.

The total length of the diverging portion is typically 139 mm. Air is designed as the main working gas and powder carrier gas. The inlet pressure of compressed air can be adjusted to a preset value up to 830 kPa (120 psi). The main process gas temperature can be varied by an in-line heater in the range of 200° C. to 500° C. The powder is injected along the radial-inward direction of the nozzle, coming from a particle feeder, through a particle injector (ceramic tube) located at 13 mm downstream of the nozzle throat where the diameter of the nozzle is 4 mm. The axis of the particle injector intersects with the axis of the nozzle at a right angle. The particle feeder operates at the atmospheric pressure (about 101.3 kPa). After being introduced into the nozzle, the particles are accelerated by the supersonic jet due to drag effect.

Governing Equations for Jet Flow Field

Jet flow existing in the cold spray exhibits a transonic behavior. The flow upstream of the nozzle throat is subsonic. The flow is choked at the throat. At the divergent portion of the nozzle, for most cold spray conditions, the jet is a supersonic nozzle flow. As the supersonic flow exits the nozzle, a series of compression/expansion waves are formed to adjust the supersonic jet to the ambient pressure. In front of the target surface, a bow shock wave is formed while the supersonic two-phase jet impinges on the substrate. The low-velocity subsonic high-pressure region is formed in front of the target surface due to the impingement.

The compression/expansion waves outside the nozzle exit and the bow shock wave in front of the substrate should have an influence on the final particle impact velocity. According to the previous studies, this influence heavily depends on the particle size and particle density. The heavier, the larger the particles are, the less the influence is. For aluminum particles, previous numerical results showed that only smaller particles (<10 μm diameter) were considerably decelerated in the compression shock.

The current study is focused on the internal jet flow and particle velocity at the exit of the nozzle. The influence from the compression/expansion waves outside the nozzle exit is neglected, and the influence from the impingement is not considered. The metal powder under study is Al and particle size is 10-40 μm.

The computational domain consists of a de Laval type nozzle with a geometry that matches the test nozzle of the experimental apparatus.

a) One Dimensional Analytic Solution

The one-dimensional isentropic gas flow in the nozzle for air (γ=1.4) was considered based on the following equations:

$$\frac{A}{A^*} = \frac{1}{Ma}\frac{(1+0.2Ma^2)^3}{1.728} \tag{1}$$

$$\frac{T_0}{T} = 1+0.2Ma^2 \tag{2}$$

$$\frac{\rho_0}{\rho} = (1+0.2Ma^2)^{2.5} \tag{3}$$

$$\frac{p_0}{p} = (1+0.2Ma^2)^{3.5} \tag{4}$$

where A is the nozzle cross-sectional flow area, Ma is Mach number, T is temperature, ρ is density, p is pressure, * denotes nozzle throat condition, and the subscript 0 denotes the gas stagnation conditions.

b) 3D Compressible Inviscid Flow Model

For downstream radial injection system, a 3D model can fit the real physics better than a 2D axis-symmetric model. A 3D model based on the transient compressible inviscid (Euler) flow assumption is proposed here. The governing equations are:

Continuity Equation:

$$\frac{\partial \rho}{\partial t} + \nabla\cdot(\rho\vec{V}) = 0 \tag{5}$$

Momentum Equation:

$$\frac{\partial(\rho\vec{V})}{\partial t} + \nabla\cdot\left(\rho\vec{V}\vec{V}^T\right) + \nabla p = \vec{F} \tag{6}$$

Energy Equation:

$$\frac{\partial}{\partial t}\left[\rho\left(e+\frac{V^2}{2}\right)\right] + \nabla\cdot\left[\rho\left(e+\frac{V^2}{2}\right)\vec{V}\right] = Q - \nabla\cdot(p\vec{V}) + \vec{F}\cdot\vec{V} \tag{7}$$

where ρ denotes the density, $\vec{V}$ is the velocity vector, p is pressure, $\vec{F}$ is a volume force, e is the specific internal energy and Q is a heat source. To provide closure, the calorically perfect gas assumption is used:

$$p=(\gamma-1)\rho e \tag{8}$$

where γ is the ratio of specific heats. For air at standard conditions, γ=1.4.

Governing Equations for Particle Movement

It is assumed that the two-phase gas-particle mixture flow is dilute enough so that the particle-particle interaction and the influence of particles on the gas flow can be neglected. The gravitational force is also neglected due to the very short residence time of the particles in the flow. Thus, the acceleration force of the particle can be equated to the drag force on the particle:

$$m\frac{d\vec{V}_p}{dt} = \frac{1}{2}C_D A_p \rho(\vec{V}-\vec{V}_p)|\vec{V}-\vec{V}_p| \tag{9}$$

where m is the mass of the particle, $\vec{V}_p$ is the particle velocity, CD the drag coefficient of the particle, $A_p$ is the projected area of the particle. In the current study, a spherical particle is assumed. The drag coefficient equation for a spherical particle in a fluid flow is:

$$C_D = \frac{k_1}{Re} + \frac{k_2}{Re^2} + k_3 \tag{10}$$

where $k_1$, $k_2$ and $k_3$ are constants (see Morsi et al. (1972) [26] for details), Re is the relative Reynolds number:

$$Re = \frac{\rho D_p|\vec{V}-\vec{V}_p|}{\mu} \tag{11}$$

where $D_p$ is the particle diameter and μ is coefficient of viscosity. The Sutherland law is used here for viscosity of air at different temperatures.

Numerical Simulation Method

The transonic compressible Euler flow is solved using commercial finite element analysis (FEA) software, COMSOL Multiphysics. It uses the streamline diffusion method (or Streamline-Upwind/Petrov-Galerkin (SUPG) method) to stabilize the discretization of the hyperbolic equations. The artificial viscosity is added to improve the stability of the solution. Due to the fact that the particles are injected radially, the axis-symmetry of the nozzle is no longer held. So, a 3D model is more physical than a 2D axis-symmetrical model. The total number of finite elements is about 27,000 cells for numerical solutions. Mathematically, the governing equations for transient Euler flow (equations 5-7) are hyperbolic and are well-posed. The steady-state solution is obtained by running the transient model until it reaches the steady state. The simulation of the particle movement is based on the steady-state jet flow field.

This inviscid model ignores the small gas flow boundary layers along the nozzle walls, where the gas flow is traveling slower than the average. In interpreting the simulation results, it should be borne in mind that the presence of the boundary layer leads to: (a) the decrease of the effective nozzle cross-sectional area in comparison to the geometrical cross-sectional area, and (b) the decrease of the jet velocity at the nozzle exit in comparison to the inviscid flow velocity.

The COMSOL Multiphysics software simulates the movement of particle (i.e. trajectory and velocity) by solving the particle drag force equation (Equation 9). A pair of Runge-Kutta methods of orders four and five are used for solving this ordinary differential equation (ODE).

Verification of Numerical Simulation Method

To validate the simulation method, laser stroboscopy and optical image analysis techniques have been used to image particles traveling away from the cold spray nozzle. The system (Laser Strobe, Control Vision Inc., Idaho Falls, Id.) used in this work incorporated two pulsed Nitrogen lasers and a fast-shutter CCD (charge-coupled device) camera. The camera was used to monitor the spraying process, while two pulsed lasers operating in the near ultraviolet wavelength were used to illuminate the particles. A double-pulse imaging technique was used in this system. During one exposure of the camera, one laser pulse was emitted from each of two laser sources separated by a preset delay time. The synchronization among the electronic shutter, camera and lasers enables twin images to be made within each frame of photo.

Using the time-of-flight method, particle velocity was calculated from the time interval, or delay, between the firing of the two lasers and the particle flying distance measured from the twin images. The size of the viewing region was about 7 mm×5 mm×1 mm. Measurements were made in the first 10 mm downstream of the nozzle exit.

Calculated average particle velocities at the nozzle exit were compared with average particle velocities measured using the optical diagnostic system to validate the numerical simulation model. To simulate particle movement, particle exit velocities were calculated based on the following particle injection conditions and/or assumptions:

Aluminum (Al) particle sizes are evenly distributed between 25 μm to 32 μm;

Particle injection locations are uniformly distributed in the plane which is located near the injector exit;

Particle injection velocity was axial with respect to the injector axis and fit to a velocity profile of:

$$V(r) = V^*_{max}\left[1 - \left(\frac{r}{R}\right)^2\right]$$

Gas inlet conditions are $P_0$=800 kPa and $T_0$=473 K (200° C.). If particles collide with the nozzle wall during movement in the nozzle, kinetic energy loss was considered. Measurement was carried out at the same conditions as simulation: $P_0$=800 kPa and $T_0$=473 K, with particle loading rate of 0.018 g/s. A low powder loading rate was chosen here to limit the influence of interaction between particles. To limit the influence from the particle size distribution, the Al powder was sieved to 25-32 μm (+500 to −450 mesh).

Table 1 compares the calculated average particle exit velocity with the average measured particle velocity at the corresponding processing parameters. The results show that the predicted particle velocities are in good agreement with the measurements. The slightly overestimation of the predicted values (about 5%) is thought mainly due to the neglect of the boundary layer in the simulation method. It is evident that the numerical simulation method is a good model for calculating particle exit velocities in cold spray systems.

TABLE 1

| Spray Condition | Measurement | Simulation |
|---|---|---|
| Particulate Material | Al powder | Al powder |
| Particle Size | 25-32 μm (sieved to +500 to −450 mesh) | 25-32 μm (evenly distributed) |
| Inlet Conditions | $P_0$ = 800 kPa, $T_0$ = 473 K | $P_0$ = 800 kPa, $T_0$ = 473 K |
| Average Particle Exit Velocity | 343 m/s | 363 m/s |

Example 2

Nozzle Design

A nozzle for a cold spray system of the present invention has a total length of 220 mm, a throat diameter of 2.15 mm, a working gas inlet diameter of 8.2 mm, and a nozzle exit diameter of 6.5 mm. Two powder injectors with 45° injection angle are axis-symmetrically located around the nozzle downstream 13 mm from the nozzle throat. Pressurized powder injectors with a pressure up to 690 kPa (100 psi)) are used to allow higher inlet pressure (up to 3-4 MPa) and larger exit Mach number (up to 4).

Example 3

Preliminary Validation Test

A preliminary test was performed using the nozzle design of Example 2. Particle exit velocities for the nozzle were measured at $P_0$=2.5 MPa and $T_0$=300 K. $T_0$ is the inlet working gas temperature. Table 2 compares average measured particle velocity with average calculated particle velocity for this cold spray system. Also for comparison, Table 2 provides calculated results for different cold spray systems of the prior art.

The results in Table 2 show that the measured average particle velocity (400 m/s) from the system of the present invention is in good agreement with the predicted average particle velocity (430 m/s). It also demonstrated that the system of the present invention has much higher particle exit velocity as compared to the commercial downstream system (only about 285 m/s) and is comparable to the results of upstream system (455 m/s) even at the current simulation conditions. Thus, systems of the present invention combine the low cost and portability of downstream design with the high particle exit velocities of upstream designs.

TABLE 2

| System Type | Centerline System | CGT 3000 | System of the Invention | |
|---|---|---|---|---|
| Method | Calculated | Calculated | Calculated | Measured |
| Injection Location | Downstream | Upstream | Downstream | Downstream |
| Working gas | Air | Nitrogen | Air or Nitrogen | Air or Nitrogen |
| Particulate Material | Al powder | Al powder | Al powder | Al powder |
| Particle Size | 25-32 μm evenly distributed | 25-32 μm evenly distributed | 25-32 μm evenly distributed | As Received (−350 mesh) |
| Inlet Conditions | $P_0$ = 0.8 MPa $T_0$ = 300 K | $P_0$ = 2.5 MPa $T_0$ = 300 K | $P_0$ = 2.5 MPa $T_0$ = 300 K | $P_0$ = 2.5 MPa $T_0$ = 300 K |
| Average Particle Exit Velocity | 285 m/s | 455 m/s | 430 m/s | 400 m/s |

Example 4

Cold Spray of Aluminum Powder Using Air or Nitrogen

Table 3 compares particle exit velocity between an existing upstream system and the system of the present invention. The data for the upstream system is from Wu et al. (2005) [24], while the data for the system of the present invention was generated from numerical simulation using the nozzle design of Example 2. Air or nitrogen was used as the working gas. Case 1 of the present system has a similar stagnation condition of working gas with the upstream system. Deposit materials are also similar (Al powder ($\rho$=2.70 g/cm$^3$) vs. Al—Si powder ($\rho$=2.66 g/cm$^3$)). But the exit particle velocity of the present system is somewhat lower than that of the prior art upstream system, which can be attributed to the particles in upstream system having longer dwelling time in the jet flow to get more acceleration from the jet.

However, it is very important to note that the local temperature at the powder injector exit for the present system is much lower than that for the upstream system (400 K vs. 773 K), which means that inlet gas temperature can be increased to increase particle velocities. Table 3 shows that, when the inlet gas temperature of the present system is increased to 1273 K, its exit particle velocity will be higher that that of the upstream system (775 m/s vs. 750 m/s), while its local temperature at the powder injector exit is still lower than the upstream system (626 K vs. 773K).

TABLE 3

| | Upstream System | System of the Invention | | |
|---|---|---|---|---|
| | [24] | Case 1 | Case 2 | Case 3 |
| $P_0$ | 2.9 MPa | 3 MPa | 3 MPa | 3 MPa |
| $T_0$ | 773 K | 773 K | 1073 K | 1273 K |
| Working gas | $N_2$ | Air | Air | Air |
| Deposit Material | Al—Si | Al | Al | Al |
| Powder Injection Pressure | 3 MPa | 500 kPa | 500 kPa | 500 kPa |

TABLE 3-continued

| | Upstream System | System of the Invention | | |
|---|---|---|---|---|
| | [24] | Case 1 | Case 2 | Case 3 |
| Local Temperature at Injector Exit | 773 K | 400 K | 530 K | 626 K |
| Particle Exit Velocity (25 μm) | 750 m/s | 655 m/s | 740 m/s | 775 m/s |

Example 5

Cold Spray of Titanium Powder Using Helium

Deposition of titanium is one important goal for cold spray process. Helium can be used as working gas for depositing Ti powder. Table 4 compares the numerical simulation results of the present system with available data from an upstream system Marrocco et al. (2006) [25]. For the present system, when the inlet gas temperature is set to 773 K or 1073 K, respectively, its local temperature at the powder injector exit is comparable to or slightly higher than that of the upstream system (280 K or 390 K vs. 298 K), while the exit particle velocities are much higher (853 m/s or 897 m/s vs. 700 m/s).

TABLE 4

| | Upstream | System of the Invention | |
|---|---|---|---|
| | System [25] | Case 4 | Case 5 |
| $P_0$ | 2.9 MPa | 3 MPa | 3 MPa |
| $T_0$ | 298 K | 773 K | 1073 K |
| Working gas | He | He | He |

TABLE 4-continued

| | Upstream System [25] | System of the Invention Case 4 | Case 5 |
|---|---|---|---|
| Deposit Material | Ti | Ti | Ti |
| Powder Injection Pressure | 3 MPa | 400 kPa | 400 kPa |
| Local Temperature at Injector Exit | 298 K | 280 K | 390 K |
| Particle Exit Velocity (25 μm) | 700 m/s | 853 m/s | 897 m/s |

From both Table 3 and Table 4, it is clearly indicated that by increasing the inlet temperature the system of the present invention can reach particle exit velocities comparable to or much higher than that of upstream systems of the prior art.

Example 6

Cold Spray of Titanium Powder Using Air or Nitrogen

One of current major bottlenecks for the application of cold spray technology is the high operation cost due to the use of expensive helium gas. The higher inlet gas pressure and temperature plus the higher exit Mach number enables the cold spray system of the present invention to produce exit particle velocity much higher than existing upstream systems, which, in turn, allows the use of low cost compressive air or nitrogen instead of expensive helium as working gas to deposit various materials (even including Ti).

Based on available information, the most advanced upstream cold spray system (CGT-4000) uses nitrogen as working gas and its maximum inlet gas pressure and temperature are 4 MPa and 800° C. (1073 K), respectively. Based on simulation, its particle exit velocity is about 710 m/s for 25 μm Ti powder (Table 5), which is just only slightly above its critical velocity and the deposition efficiency may be a concern.

TABLE 5

| | Upstream System (CGT-4000) | System of the Invention Case 6 | Case 7 | Case 8 |
|---|---|---|---|---|
| $P_0$ | 4.0 MPa | 6.0 MPa | 6.0 MPa | 6.0 MPa |
| $T_0$ | 1073 K | 1073 K | 1273 K | 1273 K |
| Designed Exit Mach Number | 3.84 | 3.84 | 3.84 | 4.2 |
| Working gas | $N_2$ | Air or $N_2$ | Air or $N_2$ | Air or $N_2$ |
| Deposit Material | Ti (25 μm) | Ti (25 μm) | Ti (25 μm) | Ti (25 μm) |
| Powder Injection Pressure | 4.1 MPa | 800 kPa | 800 kPa | 800 kPa |
| Local Temperature at Injector Exit | 1073 K | 530 K | 626 K | 626 K |
| Particle Exit Velocity (25 μm) | 710 m/s | 720 m/s | 750 m/s | 760 m/s |

By increasing the inlet gas pressure to 6 MPa, temperature to 1000° C. and exit Mach number to 4.2, the present system can produce Ti particle (25 μm) exit velocities of 760 m/s, which will be sufficient for successful deposition of Ti powder using air or nitrogen as working gas. In principle, the system of the present invention has the potential to further increase the inlet gas pressure and exit Mach number to produce even high particle exit velocity for depositing various engineering alloys that are impossible to deposit currently.

Example 7

Nozzle Cross-Sectional Shape

Cross-sectional shape of the nozzle, particularly between the particle inlets and the outlet, can have a profound effect on the quality of the cross-sectional profile of the sprayed coating. It has now been surprisingly found that nozzles having a cross-sectional shape that is narrower in a middle section than at edge sections provides better distribution of particulate material resulting in superior cross-sectional profile of the sprayed coating, especially for such applications as coatings for lap joining of metals.

Figure 6:
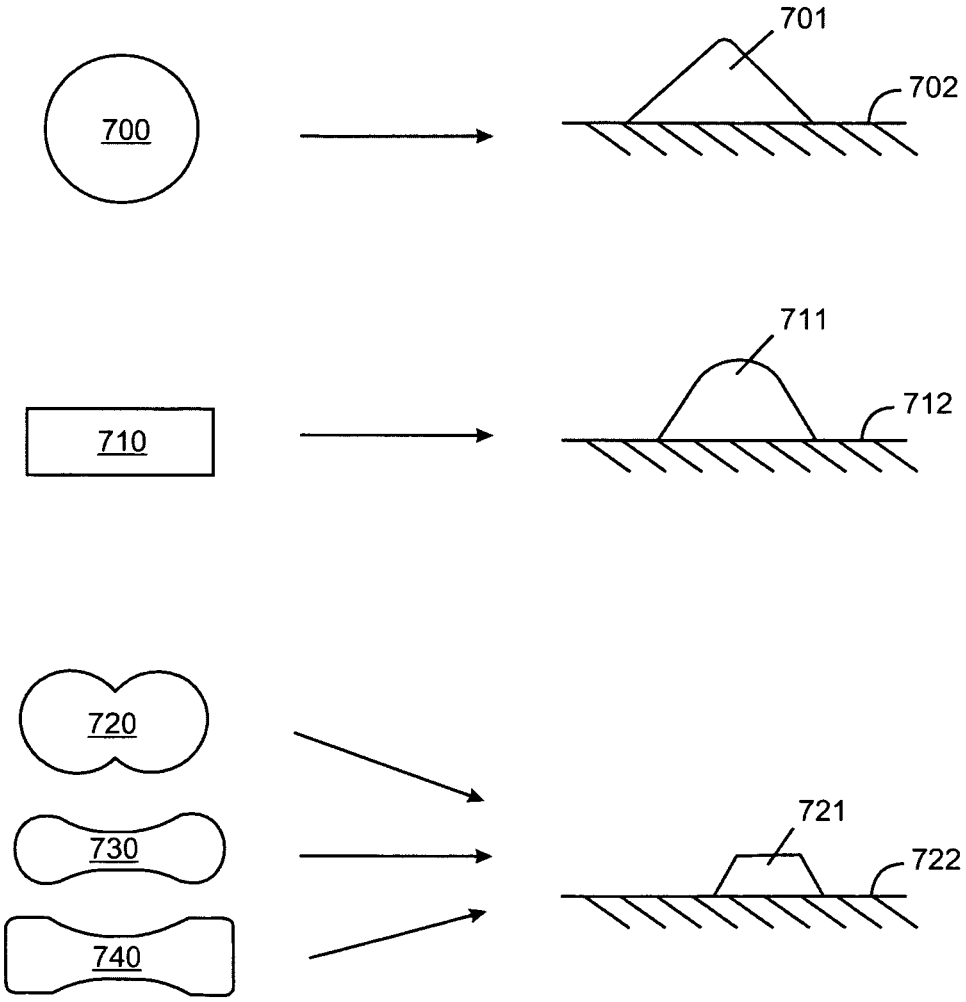
FIG. 6 is a schematic diagram depicting nozzle cross-sectional shapes through cross-section DD of FIG. 1 and cross-sectional profiles of single-track coatings produced by the cross-sectional shapes.

FIG. 6 shows various nozzle cross-sectional shapes and the cross-sectional profile of a single track coating created by each shape. Nozzle 700 has a circular cross-section which produces coating 701 on substrate 702. Coating 701 has a roughly triangular cross-sectional profile which results in a not very uniform coating on the entire surface once the spray coating is complete. Nozzle 710 has a rectangular cross-section which produces coating 711 on substrate 712. Coating 711 has a less triangular cross-sectional profile than coating 701, but it still does not have much of a plateau and results in a relatively non-uniform coating on the entire surface once the spray coating is complete. Nozzles 720, 730 and 740 are different embodiments of nozzles having a cross-sectional shape that is narrower in a middle section than at edge sections. In some cases, such a shape may be thought of as an "hourglass" shape or a "pinched" shape. Nozzles 720, 730 and 740 are all capable of producing coating 721 on substrate 722. Coating 721 has a trapezoidal cross-sectional profile in which there is a flat top or plateau, which results in a relatively uniform coating on the entire surface once the spray coating is complete.

Figure 7A:
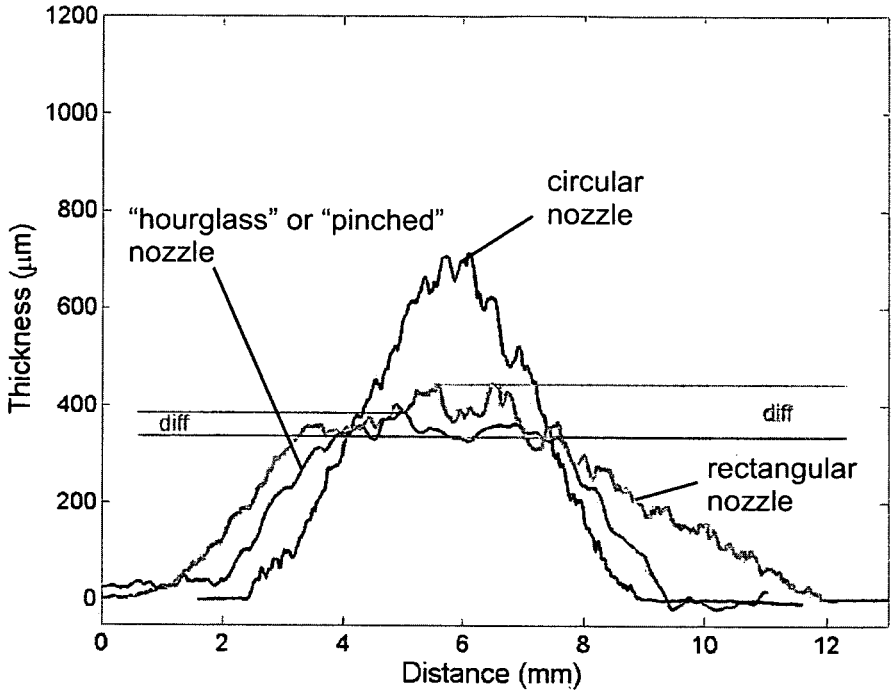
FIG. 7A is a graph comparing cross-sectional profiles of coatings produced by nozzles having different cross-sectional shapes, where thickness is coating thickness and distance is the cross-sectional distance along a line transverse to the track.
Figure 7B:
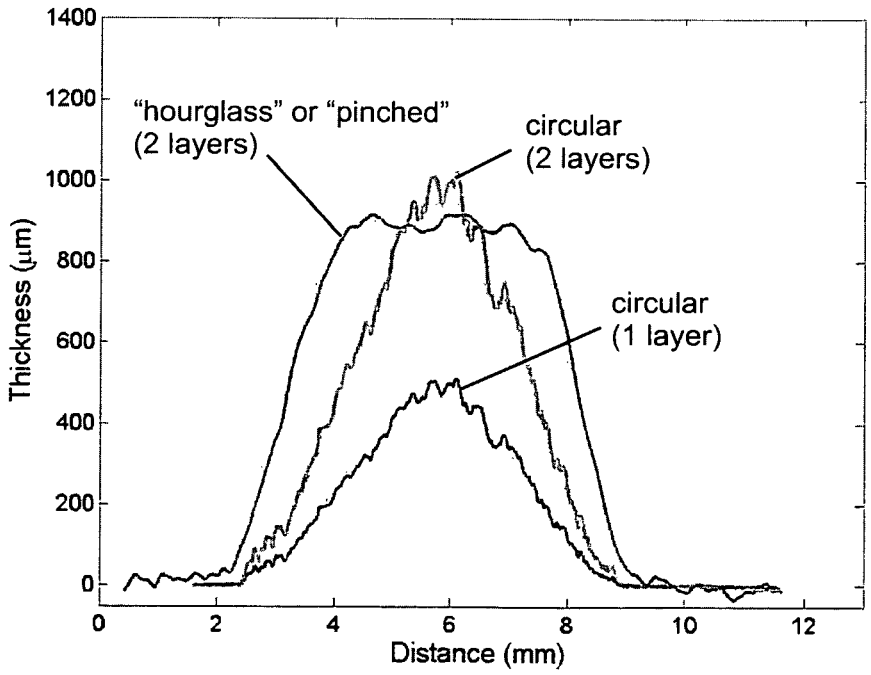
FIG. 7B is a graph comparing cross-sectional profiles of two-layered coatings produced by nozzles having different cross-sectional shapes.

FIGS. 7A and 7B graphically represent the differences in cross-sectional profile of one layer coatings (FIG. 7A) and two layer coatings (FIG. 7B) produced with different nozzle cross-sectional shapes. It is evident from FIG. 7A that circular nozzles provide very steep coatings, rectangular nozzles provide less steep coatings, but nozzles having an "hourglass" or "pinched" cross-sectional shape provide coatings with flatter top surfaces than either the circular or rectangular nozzles. Thickness variation or roughness across the flat part of the coating, represented by "diff", is smaller for coatings produced by nozzles having an "hourglass" or "pinched" cross-sectional shape than for coatings produced by circular of rectangular nozzles. The same trend can be seen in FIG. 7B for coatings produced from two passes of the nozzle where deposition uniformity is even more difficult to achieve.

REFERENCES

The contents of the entirety of each of which are incorporated by this reference.

1. A. P. Alkhimov, A. N. Papyrin, V. F. Kosarev, N. I. Nesterovich, M. M. Shushpanov, "Gas-dynamic spraying method for applying a coating", U.S. Pat. No. 5,302,414, Apr. 12, 1994.
2. T. H. Van Steenkiste, J. R. Smith, R. E. Teets, J. J. Moleski, D. W. Gorkiewicz, "Kinetic spray coating method and apparatus", U.S. Pat. No. 6,139,913, Oct. 31, 2000.
3. T. H. Van Steenkiste, J. R. Smith, R. E. Teets, J. J. Moleski, D. W. Gorkiewicz, "Kinetic spray coating apparatus", U.S. Pat. No. 6,283,386, Sep. 4, 2001.
4. T. H. Van Steenkiste, J. R. Smith, D. W. Gorkiewicz, A. A. Elmoursi, B. A. Gillispie, N. B. Patel, "Method of maintaining a non-obstructed interior opening in kinetic spray nozzles", U.S. Pat. No. 6,896,933, May 24, 2005.

5. Zhibo Zhao, Bryan A Gillispie, Taeyoung Han, Alaa A Elmoursi, Nilesh B Patel, "Continuous in-line manufacturing process for high speed coating deposition via kinetic spray process", European Patent Publication 1 630 253, 2006 Mar. 1.
6. Taeyoung Han, Zhibo Zhao, Bryan A Gillispie, John R Smith, "Kinetic spray nozzle system design", US Patent Publication 2005/0214474, 2005 Sep. 29.
7. Ko Kyung-Hyun (Kr); Lee Ha-Yong (Kr); "Nozzle for cold spray and cold spray apparatus using same", US Patent Publication 2006/0201418, 2006 Sep. 14.
8. A. I. Kashirin, O. F. Klyuev, T. V. Buzdygar, "Apparatus for gas-dynamic coating", U.S. Pat. No. 6,402,050, Jun. 11, 2002.
9. P. Heinrich, T. Stoltenhoff, P. Richter, H. Kreye, H. Richter, "Method and system for cold gas spraying", U.S. Pat. No. 7,143,967, Dec. 5, 2006.
10. Z. Zhao, B. A. Gillispie, T. Han, J. R. Smith, B. K. Fuller, "Coaxial low pressure injection method and a gas collimator for a kinetic spray nozzle", US Patent Publication US2005/0040260, Feb. 24, 2005.
11. B. K. Fuller, T. H. Van Steenkiste, "Spray system with combined kinetic spray and thermal spray ability", US Patent Publication 2004/0058064, Mar. 25, 2004.
12. T. H. Van Steenkiste, B. K. Fuller, "Spray system with combined kinetic spray and thermal spray ability", U.S. Pat. No. 7,108,893, Sep. 19, 2006.
13. T. H. Van Steenkiste, "Low pressure powder injection method and system for a kinetic spray process", U.S. Pat. No. 6,811,812, Nov. 2, 2004.
14. T. H. Van Steenkiste, D. W. Gorkiewicz, G. A. Drew, "Method for producing electrical contacts using selective melting and a low pressure kinetic spray process", U.S. Pat. No. 6,872,427, Mar. 29, 2005.
15. E. Muehlberger, "Method and apparatus for low pressure cold spraying", U.S. Pat. No. 6,759,085, Jul. 6, 2004
16. Kurisu Yasushi; Sakaki Kazuhiko, "Cold Spray Nozzle, Cold Spray Film, And Production Method Therefor", Japanese Patent Publication 2005-095886—2005 Apr. 14.
17. Roman Gr. Maev, Volf Leshchynsky, Emil E. Strumban, "Gas dynamic spray gun", US Patent Publication 2007/0160769, Jul. 12, 2007.
18. A. V. Shkodkin, "Method of gas-dynamic application of coats and nozzle unit for realization of this method", RU2201472, 2003 Mar. 27.
19. Haynes Jeffrey D (Us); Sanders Stuart A (Us), "Cold spray nozzle design", US Patent Publication 2004/0191449, 2004 Sep. 30.
20. Jiaren Jiang and Lijue Xue, "Aluminium-based composite coatings deposited using gas dynamic spray", *Proceedings of Symposium of Surface Protection for Enhanced Materials Performances, Materials Science and Technology* (*MS&T*'06), Cincinnati, Ohio, Oct. 15-19, 2006, pp. 571-582.
21. W. P. Rusch: "Method and device for applying a coating", US Patent Publication 2002/0071906; Jun. 13, 2002.
22. M. L. Thorpe and H. J. Richter, "A pragmatic analysis and comparison of HVOF processes", *Journal of Thermal Spray Technology, Vol.* 1 (1992) 161-170.
23. T. C. Hanson, C. M. Hackett, and G. S. Settles, "Independent control of HVOF particle velocity and temperature", *Journal of Thermal Spray Technology*, Vol. 11 (2002) 75-85.
24. J. Wu, H. Fang, S. Yoon, H-J Kim, and C. Lee, "Measurement of particle velocity and characterization of deposition in aluminum alloy kinetic spraying process", *Applied Surface Science*, Vol. 252 (2005), 1368-1377.
25. T. Marrocco, D. G. McCartney, P. H. Shipway, and A. J. Sturgeon. "Production of titanium deposits by cold-gas dynamic spray: numerical modeling and experiment characterization", *J. Thermal Spray Technology*, Vol. 15 (2006), No. 2, 263-272.
26. S. A. Morsi and A. J. Alexander, "An investigation of particle trajectories in two-phase flow systems", *J. Fluid Mech.*, Vol. 55 (1972), part 2, 193-208.
27. T. Schmidt, F. Gartner, H. Assadi and H. Kreye, "Development of a generalized parameter window for cold spray deposition", *Acta Materialia*, Vol. 54 (2006) 729-742.
28. J. Villafuerte, "Cold Spray: A New Technology", *Welding J.*, Vol. 84 (2005), No. 5, 24-29.
29. T. Stoltenhoff, H. Kreye and H. J. Richter, "An analysis of the cold spray process and its coatings", *Journal of Thermal Spray Technology*, Vol. 11 (2002), No. 4, 542-550.
30. E. Irissou, J-G Legoux, A. N. Ryabinin, B. Jodoin and C. Moreau, "Review on Cold Spray Process and Technology: Part I—Intellectual Property". *Journal of Thermal Spray Technology*, DOI: 10.1007/s11666-008-9203-3 (2008).
31. V. A. Polovtsev and V. I. Mikheev, "Apparatus for Gasodynamic Applying of Coatings of Powder Material", RU 2229944, Mar. 27, 2004.
32. A. I. Kashirin, O. F. Klyuev, A. V. Shkodkin, "Apparatus for Gasodynamic Applying of Coatings and Method of Coating", WO 2006-123965, Nov. 23, 2006.

Other advantages that are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A system for cold gas dynamic spraying of particulate material, the system comprising:

(a) a nozzle having a first, substantially linear, flow path from a first end to a second end, the first flow path having a cross-sectional area that converges from the first end to a throat of minimum cross-sectional area and diverges from the throat to the second end, a working gas inlet proximal the first end to permit working gas to enter the first flow path substantially parallel to the first flow path, two or more particle inlets at a location between the throat and the second end to permit particulate material to enter the first flow path at the location, the two or more particle inlets arranged symmetrically around the first flow path, the two or more particle inlets having particle flow paths therein, and an outlet at the second end through which the particulate material exits the nozzle, substantially all of the particulate material being in solid phase when exiting the nozzle;

(b) one or more non-combustion sources of pressurized working gas in fluid communication with the working gas inlet;

(c) one or more sources of the particulate material in particle flow communication with the two or more particle inlets; and, (d) a sink coupled between the one or more particulate material sources and the two or more particle inlets for clearing the two or more particle inlets of residual particulate material when the system is not spraying the particulate material out the nozzle, the sink operable to reduce a pressure in a chamber that is selectively coupled to the two or more particle inlets between the two or more particle inlets and the one or more particulate material sources, so that the pressure in the chamber becomes lower than that of the particle flow communication to draw the residual particulate material into the chamber; wherein the sink comprises a valve for controlling communication between the two or more particle inlets and the chamber, and wherein the chamber is connected to an exhaust port through which the particles drawn out of the particle inlets are expelled.

2. The system of claim 1, wherein a ratio between total cross-sectional area of the two or more particle inlets and cross-sectional area of the nozzle at the location is in a range of from 0.04 to 0.25.

3. The system of claim 1, wherein each particle inlet has an inner cross-sectional area of no less than 0.10 $mm^2$ where the particle inlet meets the nozzle.

4. The system of claim 1, wherein the two or more particle inlets are two particle inlets.

5. The system of claim 1, wherein the minimum cross-sectional area of the nozzle at the throat is in a range of from 0.2-33 $mm^2$.

6. The system of claim 1, wherein the throat has a circular cross-section.

7. The system of claim 1, wherein the nozzle has a length of 150 mm or longer.

8. The system of claim 1, wherein the nozzle has a length in a range of from 150-400 mm.

9. The system of claim 1, further comprising a working gas heater for providing a working gas temperature of 800° C. or higher at the working gas inlet.

10. The system of claim 1, further comprising a working gas heater for providing a working gas temperature of 1200° C. or higher at the working gas inlet.

11. The system of claim 1, further comprising a particle heater for providing a particle temperature at the particle inlets in a range of from 0.5-0.9 times the absolute melting temperature of the particulate material.

12. The system of claim 1, wherein the particulate material has an average particle diameter in a range of from 1-200 μm.

13. The system of claim 1, wherein the particulate material comprises an oxygen-sensitive material, a temperature-sensitive material, a phase-sensitive material or any mixture thereof.

14. The system of claim 1, wherein the particulate material comprises a metal, a metal alloy, an organic polymer, a ceramic, any composite thereof or any mixture thereof.

15. The system of claim 1, wherein the particulate material comprises Al, Mg, Ti, Cu, Fe, Ni, Zn, V, Ta, Au, Ag, Co, Zr, Sn, Nb, Mo, Pb, W or any mixture thereof.

16. The system of claim 1, wherein the one or more sources of the particulate material are adapted to inject the particulate material with a pressurized carrier gas, and the one or more non-combustion sources of pressurized working gas is adapted to inject working gas with a pressure of the working gas ($P_0$) and an injection pressure of the carrier gas ($P_{inj}$) provided in accordance with expression Z:

$$P_0/P_{inj} \leq a(A_{inj}/A^*)^2 + b(A_{inj}/A^*) + c \quad (Z)$$

wherein $P_{inj}$ is greater than atmospheric pressure, A* is the minimum cross-sectional area of the throat, $A_{inj}$ is cross-sectional area of the nozzle at the location of the two or more particle inlets, $0 \leq a \leq 5.0$, $2.0 \leq b \leq 10.0$, and $-15.0 \leq c \leq -2.0$.

17. The system of claim 16, wherein $0.8 \leq a \leq 2.5$, $5.0 \leq b \leq 8.0$, and $-10.0 \leq c \leq -4.0$.

18. The system of claim 1, wherein, between the particle inlets and the outlet, the nozzle has a cross-sectional shape having a narrower middle section than edge sections.

19. The system of claim 1, comprising two or more sets of the two or more particle inlets, each set being disposed symmetrically around the nozzle at a different location between the throat and the second end than another set.

20. The system of claim 19, wherein each of the one or more particulate material sources is in particle flow communication with a respective one of the two or more sets of two or more particle inlets by a particle feed line for each of the two or more particle inlets in the set.

21. The system of claim 20, wherein the particle flow communication is provided from the one or more sources of particulate material to the two or more particle inlets by respective particle feed lines.

22. The system of claim 20, wherein each of the particle inlets has an axis meeting an axis of the nozzle at an angle of about 5° to 85°.

23. The system of claim 1, wherein the sink includes a pressure sink coupled to a plurality of particle feed lines connecting one of the one or more particulate material sources to respective particle inlets.

24. The system of claim 1, wherein the sink comprises a flow control for selectively drawing particles from the particle flow communication after a cold spray operation.

25. The system of claim 24 wherein the flow control comprises a valve for controlling a venturi flow and a valve for coupling the venturi to a particle feed line extending between the one or more particulate material sources and particle inlets.

* * * * *